US011085296B2

(12) United States Patent
Ju et al.

(10) Patent No.: US 11,085,296 B2
(45) Date of Patent: Aug. 10, 2021

(54) METHOD FOR CONTROLLING SUBSIDENCE AREA CAUSED BY UNDERGROUND MINING IN ADJOINING OPEN-PIT MINE

(71) Applicant: China University of Mining and Technology, Jiangsu (CN)

(72) Inventors: Feng Ju, Jiangsu (CN); Shuai Guo, Jiangsu (CN); Zhipeng Fu, Jiangsu (CN); Peng Huang, Jiangsu (CN); Pingshan Li, Jiangsu (CN); Yunfei Liu, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 40 days.

(21) Appl. No.: 16/605,122

(22) PCT Filed: Jun. 6, 2017

(86) PCT No.: PCT/CN2017/087329
§ 371 (c)(1),
(2) Date: Feb. 19, 2020

(87) PCT Pub. No.: WO2018/192066
PCT Pub. Date: Oct. 25, 2018

(65) Prior Publication Data

US 2020/0300090 A1 Sep. 24, 2020

(30) Foreign Application Priority Data

Apr. 19, 2017 (CN) ..... 201710256261.3

(51) Int. Cl.
*E21F 15/00* (2006.01)
*E21C 41/16* (2006.01)

(52) U.S. Cl.
CPC ..... *E21F 15/00* (2013.01); *E21C 41/16* (2013.01)

(58) Field of Classification Search
CPC ..... E21C 41/16; E21C 41/32; E21F 15/00
See application file for complete search history.

(56) References Cited

U.S. PATENT DOCUMENTS 3,852,967 A 12/1974 Stewart et al.
9,494,037 B2 * 11/2016 Zhang ..... E21D 23/0481
(Continued)

FOREIGN PATENT DOCUMENTS

CN 106368207 A 2/2017
CN 106437719 A 2/2017
CN 106555607 A 4/2017

OTHER PUBLICATIONS

Johnson, C.P., "A Guide to Surface Features Related to Underground Coal Mining", 2013, University of Washington (Year: 2013).*

*Primary Examiner* — Carib A Oquendo
(74) *Attorney, Agent, or Firm* — TraskBritt

(57) ABSTRACT

A method for controlling a subsidence area caused by underground mining in an adjoining open-pit mine, applied in an open-pit and underground coordinated mining process. In the method, a ground subsidence area caused by underground mining and production is directly filled and covered with overburden materials such as soil and rock discharged from an adjoining open-pit mine; small and medium fracture zones and large fracture zones caused by mining are timely backfilled, tamped, and levelled according to areas before the ground subsidence area appears, the thickness of the levelled soil layer is kept above 1 m, and the area slope is controlled within 7°. By fully using overburden materials from an adjoining open-pit mine, the method controls a subsidence area caused by underground mining and greatly
(Continued)

shortens the discharge distance of the overburden materials from the adjoining open-pit mine, also solves the safety problems such as air leakage and spontaneous combustion of coal caused by fractures in mine subsidence, and brings significant economic and social benefits.

4 Claims, 1 Drawing Sheet

(56) References Cited

U.S. PATENT DOCUMENTS

| | | | | |
|---|---|---|---|---|
| 10,012,080 | B2 * | 7/2018 | Ma | E21C 41/16 |
| 2015/0239782 | A1 * | 8/2015 | Purcell, Jr. | E21B 43/12 166/305.1 |
| 2016/0326872 | A1 * | 11/2016 | Zhao | E21C 41/32 |
| 2019/0186095 | A1 * | 6/2019 | Eddie | E02D 3/12 |
| 2019/0308229 | A1 * | 10/2019 | Yost | B09B 3/0016 |

* cited by examiner

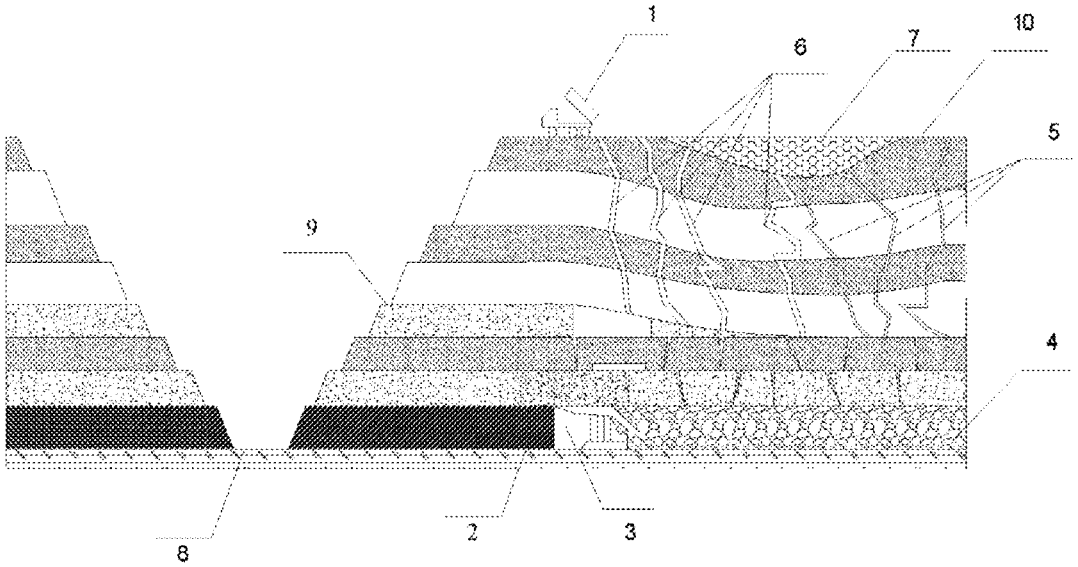
1
6
7
10
5
9
4
8
2
3

METHOD FOR CONTROLLING SUBSIDENCE AREA CAUSED BY UNDERGROUND MINING IN ADJOINING OPEN-PIT MINE

CROSS-REFERENCE TO RELATED APPLICATIONS

This application is a national phase entry under 35 U.S.C. § 371 of International Patent Application PCT/CN2017/087329, filed Jun. 6, 2017, designating the United States of America and published as International Patent Publication WO 2018/192066 A1 on Oct. 25, 2018, which claims the benefit under Article 8 of the Patent Cooperation Treaty to Chinese Patent Application Serial No. 201710256261.3, filed Apr. 19, 2017.

TECHNICAL FIELD

This disclosure relates to a method for controlling a subsidence area caused by underground mining adjoining open-pit mine, particularly to a method for controlling a subsidence area caused by underground mining adjoining open-pit mine used in the subsidence area incurred by underground mining in a collaborative process of open-pit mining and underground mining.

BACKGROUND

In recent years, underground mining in coal mines has resulted in large subsidence areas. To treat such subsidence areas, filling materials outside the mining area usually have to be transported to fill and cover fractures of subsidence area caused by underground mining, and the costs of transportation and material are high. In view of the above problems, this disclosure provides a method for controlling a subsidence area caused by underground mining adjoining open-pit mine, which can reduce costs and expenses, and effectively control the subsidence area as well. The method is simple and easy to operate, low cost, and has important practical significance and wide application prospects.

BRIEF SUMMARY

Technical Problem: the purpose of this disclosure is to overcome the drawbacks in the prior art, and to provide a method for controlling a subsidence area caused by underground mining adjoining open-pit mine, with simple construction, local materials, and low cost.

Technical Scheme: to achieve the above-mentioned technical objective, the method for controlling a subsidence area caused by underground mining adjoining open-pit mine in this disclosure comprises the following steps:

a. with the advance of the open-pit mine, a goaf is formed in an underground mining face along with the advance of the open-pit mine; along with the collapse of the overlying strata, two types of damaged zones reaching the ground surface in different sizes are formed, the two types of damaged zones are medium and small fracture zones and large fracture zones, and a surface subsidence area is formed; collecting the soil and rock strippings produced in the open-pit mine;

b. screening and classifying the strippings to obtain rock and soil substances, transporting the strippings to the subsidence area to fill the fractures in different widths in the subsidence area on the ground surface respectively;

for medium and small fractures with the width of smaller than 0.3 m in the surface subsidence area, the screened soil is filled into the medium and small fractures first; when the fractures are filled to an elevation at the distance of 3 m from the pit bottom of the subsidence area, filling the medium and small fractures with small rock blocks, till the pit bottom of the subsidence area is reached;

for large fractures with the width of greater than 0.3 m in the surface subsidence area, the screened large rock blocks are filled into the cavities in the large fractures first, and then continue to fill with small rock blocks screened from the strippings, till the pit bottom of the subsidence area is reached;

c. after all medium and small fractures and large fractures in the subsidence area are filled, compacting the pit bottom of the subsidence area dynamically, and then filling the subsidence area with the screened large rock blocks to an elevation at the distance of 2 m from the ground surface, filling the subsidence area further with small rock blocks screened from the strippings till all of subsidence area are covered by the large rock blocks, then grouting the cement mortar into the subsidence area to an elevation at the distance of 1 m from the ground surface; after the cement mortar is completely solidified, covering the filled cement mortar with the soil screened from the strippings, and compacting in layers at intervals of about 0.3 m, till the filling surface is flush with the ground surface; and d. new medium and small fracture zones, large fracture zones and surface subsidence area are formed along with further advance of the underground mining face, repeat the steps a, b and c till all fractures and subsidence areas disappear and the collapse of the ground surface stops.

The medium and small fracture zones and the large fracture zones are backfilled and compacted in layers, wherein the ratio of the particle size of the rock used for the backfilling to the width of the current fracture is smaller than 1:3 in the backfilling process, and the compaction in layers to the surface soil and the compaction to the pit bottom of the subsidence area are dynamic compaction, 3 times of point compaction, skipped compaction at interval and 1 time of full compaction.

With the advance of the underground mining face, the ground surface is backfilled timely before medium and small fracture zones and large fracture zones are formed in the ground surface; the slope of the subsidence area shall not be greater than 7° after the subsidence area is leveled, the thickness of the cement mortar grouted in the concrete layer shall not be smaller than 0.5 m, and the thickness of the soil discharged from the open-pit mine backfilled in the surface layer shall not be smaller than 1 m.

Beneficial effects: 1) the material and transportation costs of the filling materials are greatly reduced since the filling materials are obtained from the strippings produced in the adjoining open-pit mine; 2) the problems of large amount of surface space occupation and high transportation cost of the strippings produced in the mining of the open-pit mine are solved; 3) the air passages from the ground surface to the stope are blocked, air leakage from the coal mining face is prevented, and safe underground mining is ensured. The method has high practicability in the present technical field.

BRIEF DESCRIPTION OF THE DRAWINGS

FIG. 1 is a schematic diagram of subsidence area treatment in this disclosure;

In the FIGURE: 1—truck; 2—coal; 3—underground mining face; 4—goaf; 5—medium and small fracture or fracture zones; 6—large fracture or fracture zone; 7—subsidence area; 8—open-pit mine, 9—end slope of open-pit mine; 10—ground surface.

DETAILED DESCRIPTION

Hereunder, this disclosure will be further detailed in an embodiment with reference to the drawings.

As shown in FIG. 1, the method for controlling a subsidence area caused by underground mining adjoining open-pit mine in this disclosure comprises the following steps:

a. with the advance of the open-pit mine 8 and the coal 2 is removed, a goaf 4 is formed in an underground mining face 3 along with the advance of the open-pit mine 8; along with the collapse of the overlying strata, two types of damaged zones reaching the ground surface 10 in different sizes are formed, and the two types of damaged zones are medium and small fracture zones 5 and large fracture zones 6, and a surface subsidence area 7 is formed; collecting the soil and rock strippings produced in the open-pit mine 8;

b. screening and classifying the strippings to obtain rock and soil substances, transporting the strippings to the subsidence area 7 to fill the fractures in different widths in the subsidence area on the ground surface 10 respectively;

for medium and small fractures 5 with the width of smaller than 0.3 m in the surface subsidence area 7, the screened soil is filled into the medium and small fractures 5 first; when the fractures are filled to an elevation at the distance of 3 m from the pit bottom of the subsidence area 7, filling the medium and small fractures 5 with small rock blocks, till the pit bottom of the subsidence area 7 is reached;

for large fractures 6 with the width of greater than 0.3 m in the surface subsidence area 7, screened large rock blocks are filled into the cavities in the large fractures 6 first, and then continue to fill with small rock blocks screened from the strippings, till the pit bottom of the subsidence area 7 is reached;

the medium and small fracture zones 5 and the large fracture zones 6 are backfilled and compacted in layers, wherein the ratio of the particle size of the rock used for the backfilling to the width of the current fracture is smaller than 1:3 in the back-filling process, and the compaction in layers to the surface soil and the compaction to the pit bottom of the subsidence area are dynamic compaction, 3 times of point compaction, skipped compaction at an interval and 1 time of full compaction;

c. after all medium and small fractures 5 and large fractures 6 in the subsidence area 7 are filled, compacting the pit bottom of the subsidence area 7 dynamically, and then filling the screened large rock blocks into the subsidence area 7 to an elevation at the distance of 2 m from the ground surface, filling the subsidence area 7 further with small rock blocks screened from the strippings till all of subsidence area 7 are covered by the large rock blocks, then grouting a cement mortar into the subsidence area 7 to an elevation at the distance of 1 m from the ground surface 10; after the cement mortar is completely solidified, covering the filled cement mortar with the soil screened from the strippings, and compacting in layers at intervals of about 0.3 m, till the filling surface is flush with the ground surface; and d. new medium and small fracture zones 5, large fracture zones 6, and surface subsidence area 7 are formed along with further advance of the underground mining face 3, repeat the steps a, b and c till all fractures and subsidence areas disappear and the collapse of the ground surface 10 stops.

With the advance of the underground mining face 3, the ground surface 10 is backfilled timely before medium and small fracture zones 5 and large fracture zones 6 are formed in the ground surface 10; the slope of the subsidence area 7 shall not be greater than 7° after the subsidence area 7 is leveled, the thickness of the cement mortar grouted in the concrete layer shall not be smaller than 0.5 m, and the thickness of the soil discharged from the open-pit mine backfilled in the surface layer shall not be smaller than 1 m.

Example

First, a goaf 4 is formed in an underground mining face 3 along with the advance. Along with the collapse of overlying strata, two types of damaged zones, i.e., medium and small fracture zones 5 and large fracture zones 6, reaching to the ground surface 10 in different sizes are formed, and a surface subsidence area 7 is formed. Wherein, before the medium and small fracture zones 5, large fracture zones 6, and surface subsidence area 7 are formed in the mining process, back-filling, compaction, and leveling are carried out in each zone, the thickness of the leveled soil layer is kept above 30 cm, and the slope in each zone is controlled within 7°.

With the advance of the open-pit mine 8, the generated strippings (such as soil and rock, etc.) are transported from the pit bottom up to the subsidence area 7 by means of a truck 1 via an end slope 9 of the open-pit mine 8, the strippings are screened and separated into rock and soil on the ground surface 10, and then fractures in different widths in the subsidence area are treated respectively first:

1) for medium and small fractures 5 with the width of smaller than 0.3 m in the surface subsidence area 7, the medium and small fractures 5 are filled with the screened soil first; when the fractures are filled to an elevation at the distance of 3 m from the pit bottom of the subsidence area 7, the medium and small fractures 5 are filled with small rock blocks, till the pit bottom of the subsidence area 7 is reached;

2) for large fractures 6 with the width of greater than 0.3 m in the surface subsidence area 7, screened large rock blocks are filled into the cavities in the large fractures 6 first, and then continue to fill the large fractures 6 with small rock blocks screened from the strippings, till the pit bottom of the subsidence area 7 is reached;

3) after the fractures 5 and 6 are filled, the pit bottom of the subsidence area 7 is dynamically compacted by dynamic compaction, and then the subsidence area 7 is filled with screened large rock blocks to an elevation at the distance of 2 m from the ground surface, then the subsidence area 7 is further filled with small rock blocks screened from the strippings till all of subsidence area 7 are covered by the large rock blocks, then the cement mortar is grouted into the subsidence area 7 to an elevation at the distance of 1 m from the ground surface 10; after the cement mortar is completely solidified, the filled cement mortar is covered with the soil screened from the strippings, and then compaction in layers is performed at intervals of about 0.3 m, till the filling surface is flush with the ground surface 10;

4) new medium and small fracture zones 5, large fracture zones 6, and surface subsidence area 7 are formed along with further advance of the underground mining face 3, repeat steps a, b and c, till all fractures and subsidence areas disappear and the collapse of the ground surface 10 stops.

The invention claimed is:

1. A method for controlling a subsidence area caused by underground mining adjoining an open pit mine, wherein the method comprises the following steps:

a. with an advance of the open-pit mine, a goaf is formed in an underground mining face along with the advance; along with a collapse of an overlying strata, two types of damaged zones, including medium and small fracture zones and large fracture zones, reaching a ground surface in different sizes, and a surface subsidence area are formed;

collecting soil and rock strippings produced in the open-pit mine;

b. screening and classifying the strippings to obtain rock and soil substances, transporting the strippings to the subsidence area to fill the fractures in different widths in the subsidence area on the ground surface respectively;

for medium and small fractures with a width of smaller than 0.3m in the surface subsidence area, a screened soil is filled into the medium and small fractures first; when the fractures are filled to an elevation at a distance of 3m from a pit bottom of the subsidence area, filling the medium and small fractures with small rock blocks, till the pit bottom of the subsidence area is reached;

for large fractures with a width of greater than 0.3m in the surface subsidence area, screened large rock blocks are filled into cavities in the large fractures first, and then continue to fill the large fractures with small rock blocks screened from the strippings, till the pit bottom of the subsidence area is reached;

c. after all medium and small fractures and large fractures in the subsidence area are filled, compacting the pit bottom of the subsidence area by dynamic compaction, and then filling the screened large rock blocks into the subsidence area to an elevation at the distance of 2m from the ground surface, filling the subsidence area further with small rock blocks screened from the strippings till all of subsidence area are covered by the large rock blocks, then grouting a cement mortar into the subsidence area to an elevation at a distance of 1m from a ground surface; after the cement mortar is completely solidified, covering the filled cement mortar with the soil screened from the strippings, and compacting in layers at intervals of about 0.3m, till a filling surface is flush with the ground surface; and d. new medium and small fracture zones, large fracture zones, and surface subsidence area are formed along with further advance of the underground mining face, repeat the steps a, b and c, till all fractures and subsidence areas disappear and the collapse of the ground surface stops.

2. The method of claim 1, wherein, the medium and small fracture zones and the large fracture zones are backfilled and compacted in layers, wherein the ratio of the particle size of the rock used for a backfilling to the width of the current fracture is smaller than 1:3 in the backfilling process, and the compaction in layers to the surface soil and the compaction to the pit bottom of the subsidence area are dynamic compaction, 3 times of point compaction, skipped compaction at interval and 1 time of full compaction.

3. The method of claim 1, wherein, with the advance of the underground mining face, the ground surface is backfilled timely before medium and small fracture zones and large fracture zones are formed in the ground surface; the slope of the subsidence area shall not be greater than 7° after the subsidence area is leveled, the thickness of the cement mortar grouted in a concrete layer shall not be smaller than 0.5m, and the thickness of the soil discharged from the open-pit mine backfilled in the surface layer shall not be smaller than 1m.

4. A method of stabilizing an area associated with underground mining adjacent an open pit mine, the method comprising the following steps:

a. with an advance of the open-pit mine, forming a goaf in the underground mining face along with the advance, thus forming two types of damage zones with the collapse of overlying strata, (wherein the damage zones are medium and small fracture zones and large fracture) zones, which damage zones reach the ground surface in different sizes, forming a surface subsidence area, and collecting soil and rock strippings produced in the open-pit mine;

b. screening the collected soil and rock strippings to obtain rock and soil substances, filling fractures of different widths in the surface subsidence area and on the ground surface with the substances, by (i), for medium and small fractures having a width of less than about 0.3 meters in the surface subsidence area, filling screened soil into the medium and small fractures; after filling the medium and small fractures to an elevation at a distance of about 3 meters from the bottom of the surface subsidence area, filling the medium and small fractures with small rock blocks, until a bottom of the surface subsidence area is reached, and (ii), for large fractures having a width of greater than about 0.3 meters in the surface subsidence area, first filling screened large rock blocks into cavities in large fractures, and then continuing filling the large fractures with small rock blocks screened from the strippings, until the bottom of the surface subsidence area is reached;

c. after filling the medium and small fractures and the large fractures in the surface subsidence area, then compacting the bottom of the surface subsidence area, and then placing screened large rock blocks into the surface subsidence area to an elevation at a distance of about 2 meters from the ground surface, filling and covering the surface subsidence area further with screened large rock blocks, then grouting mortar into the surface subsidence area to an elevation at a distance of about 1 meter from the ground surface;

after the mortar solidifies, covering the solidified mortar with soil screened from the strippings, and compacting it in layers at intervals of about 0.3 meters, until a filling surface is flush with the ground surface; and d. while forming new medium and small fracture zones, large fracture zones, and surface subsidence area with further advance of the underground mining face, repeating steps a, b and c, until fractures and subsidence areas and ground surface collapse are reduced.

* * * * *